US011787224B2

(12) United States Patent
Ben-David

(10) Patent No.: US 11,787,224 B2
(45) Date of Patent: Oct. 17, 2023

(54) FRACTAL-BASED MANDALA DRAWING TOOLSET

(71) Applicant: Yaaqov Israel Ben-David, Nahariya (IL)

(72) Inventor: Yaaqov Israel Ben-David, Nahariya (IL)

( * ) Notice: Subject to any disclaimer, the term of this patent is extended or adjusted under 35 U.S.C. 154(b) by 0 days.

(21) Appl. No.: 17/615,666

(22) PCT Filed: Jun. 10, 2020

(86) PCT No.: PCT/IL2020/050640

§ 371 (c)(1),
(2) Date: Dec. 1, 2021

(87) PCT Pub. No.: WO2020/250222

PCT Pub. Date: Dec. 17, 2020

(65) Prior Publication Data

US 2022/0219484 A1 Jul. 14, 2022

(30) Foreign Application Priority Data

Jun. 11, 2019 (IL) ..... 267222

(51) Int. Cl.
*B43L 7/00* (2006.01)
*B43L 7/08* (2006.01)
*B43L 13/14* (2006.01)

(52) U.S. Cl.
CPC ..... *B43L 7/005* (2013.01); *B43L 7/08* (2013.01); *B43L 13/145* (2013.01)

(58) Field of Classification Search
CPC ..... B43L 7/005; B43L 7/08; B43L 13/145; B43L 7/00; B44D 2/002
See application file for complete search history.

(56) References Cited

U.S. PATENT DOCUMENTS 1,488,482 A 4/1924 Eckman
2,803,069 A * 8/1957 Struna ..... G09B 19/02 434/196

(Continued)

FOREIGN PATENT DOCUMENTS

CN 204196540 3/2015
DE 35 18 018 A1 11/1986

(Continued)

OTHER PUBLICATIONS

International Search Report for PCT/IL2020/050640; dated Jul. 28, 2020 (4 pages).

(Continued)

*Primary Examiner* — Yaritza Guadalupe-McCall
(74) *Attorney, Agent, or Firm* — ROACH, BROWN, MCCARTHY & GRUBER, P.C.; Kevin D. McCarthy

(57) ABSTRACT

The present invention relates to a fractal-based mandala drawing toolset, comprising at least one pair of rulers each having a different cross-sectional width, where each pair of rulers is related by the ratio between their cross-sectional widths, wherein said related pair of rulers and the combination of their widths are utilized for drafting a master grid with a predetermined shape and resolution, which is utilized as the infrastructure for creating a mandala drawing.

8 Claims, 21 Drawing Sheets

(56) References Cited

U.S. PATENT DOCUMENTS

| | | | | | |
|---|---|---|---|---|---|
| 3,509,632 | A * | 5/1970 | Allison | B43L 13/141 | 33/468 |
| 3,930,314 | A * | 1/1976 | Iwanicki | B43L 13/04 | 33/443 |
| 4,178,709 | A * | 12/1979 | Ford | B43L 13/14 | 40/503 |
| 4,391,045 | A * | 7/1983 | Fisher | B43L 13/201 | 33/27.11 |
| 4,490,921 | A * | 1/1985 | Woods | B43L 13/205 | 33/476 |
| 4,584,042 | A * | 4/1986 | Wandroik | B44C 1/20 | 434/84 |
| 4,653,194 | A * | 3/1987 | Kim | G01B 3/1084 | 33/DIG. 1 |
| 4,660,293 | A * | 4/1987 | Kovacs | G01B 3/56 | 33/495 |
| 4,688,330 | A * | 8/1987 | Konrad | B43L 13/205 | 33/565 |
| 5,915,807 | A * | 6/1999 | Ilagan | B43L 13/08 | 33/425 |
| 6,467,179 | B1 * | 10/2002 | Wolf | B43L 7/027 | 33/465 |
| 8,458,918 | B2 * | 6/2013 | Ostberg | B43L 13/205 | 33/562 |
| 10,955,232 | B2 * | 3/2021 | Swisterski | G01B 3/004 | |
| 11,279,167 | B2 * | 3/2022 | Moghadampour | B43L 13/04 | |
| 2006/0283032 | A1 * | 12/2006 | Yang | B43L 13/028 | 33/419 |
| 2012/0210587 | A1 * | 8/2012 | Ostberg | B43L 13/205 | 33/32.2 |
| 2014/0075771 | A1 * | 3/2014 | Yeh | B43L 13/205 | 33/566 |
| 2017/0032697 | A1 | 2/2017 | Alibozek | | |
| 2020/0011647 | A1 * | 1/2020 | Swisterski | G01B 3/004 | |
| 2021/0101404 | A1 * | 4/2021 | Skinner | B44F 1/10 | |
| 2022/0219484 | A1 * | 7/2022 | Ben-David | B44D 2/002 | |

FOREIGN PATENT DOCUMENTS

| | | | | |
|---|---|---|---|---|
| EP | 36732 | A * | 9/1981 | B43L 11/08 |
| EP | 2490902 | | 11/2013 | |
| FR | 2893534 | | 5/2007 | |
| JP | 5224624 | | 7/2013 | |
| KR | 101 187 820 | B1 | 10/2012 | |
| TR | 201610892 | | 2/2018 | |
| WO | WO-9712767 | A1 * | 4/1997 | B43L 7/10 |
| WO | WO-2004003465 | A1 * | 1/2004 | B43L 13/002 |
| WO | 2019/016832 | A1 | 1/2019 | |

OTHER PUBLICATIONS

Written Opinion of the International Searching Authority for PCT/IL2020/050640; dated Jul. 28, 2020 (5 pages).

Stang, Paul F., and Czech Republic "Mandala and 5,6,& 7 fold division of the circle", Bridges London: Mathematics, Music, Art, Architecture, Culture, Tarquin Publications 2006 (2 pages).

Atasay Merve et al., Linking Mathematics with Art: Using Mandala Pattern for the Teaching of Symmetry: Ogretim Teknolojileri & Ogretmen Egitimi Dergisi, 58-77, Dec. 31, 2017 (20 pages).

Communication and Supplementary European Search Report for EP 20 82 2171; dated May 9, 2023; 8 pages.

* cited by examiner

FRACTAL-BASED MANDALA DRAWING TOOLSET

FIELD OF THE INVENTION

The current invention is in the field of handheld drawing tools. More specifically, the invention relates to a fractal-based mandala drawing toolset.

BACKGROUND OF THE INVENTION

The process of creating a mandala such as a fractal-based mandala (e.g., six-leaf mandala) can contribute to improvement of concentration/focus of a user.

Creating a fractal-shaped mandala can be based on a master grid, composed by drawing equally spaced longitudinal lines and equally spaced traverse lines, with a predetermined ratio between the longitudinal and the traverse measure of spaces. The next step is a sub-division of the master grid by connecting the junctions of the crossing lines by straight lines or by round lines, creating new junctions, followed by additional subdivision. The number and shape of subdivisions will determine the final shape of the mandala, which can be creatively colored. The ratio between the longitudinal and the traverse spaces determines the shape and resolution of the created mandala.

The current invention provides with a user-friendly drawing toolset, to allow an easier drawing of the said master grid and of the required lines, arcs and other optional shapes for creating a fractal-based mandala, e.g., of a six leafs type.

SUMMARY OF THE INVENTION

The present invention relates to a fractal-based mandala drawing toolset, comprising at least one pair of rulers each having a different cross-sectional width, where each pair of rulers is related by the ratio between their cross-sectional widths, wherein said related pair of rulers and the combination of their widths are utilized for drafting a master grid with a predetermined shape and resolution, which is utilized as the infrastructure for creating a mandala drawing.

According to an embodiment of the invention, at least one of the rulers is marked with scales of and unit of measure marking.

According to an embodiment of the present invention, each pair of rulers is related by the ratio between their units of measure.

According to an embodiment of the invention, a single ruler is utilized in lieu of the related pair of rulers, by sizing or by marking two longitudinal faces of said single ruler in the same manner as two rulers of the related pair are sized or marked.

According to an embodiment of the invention, at least one pair of rulers utilize 7/8 and 7/16 ratios for the rulers' (or ruler longitudinal face's) sizes or unit of measures markings.

According to an embodiment of the invention, each related pair of rulers comprises of a unique joining method, to allow the exclusive joining of only two related rulers of said pair.

According to an embodiment of the invention, rulers of similar utilized ratios (e.g., 7/8 and 7/16) comprises of a unique joining method, to allow their joining as a set.

According to an embodiment of the invention, the toolset further comprising thin rulers, in which various shaped template cutouts are embedded to allow the drawing of uniform lines, or arcs.

According to an embodiment of the invention, the toolset further comprising at least one booklet, which includes appropriate guidelines for drawing fractal-based mandalas by using the rulers

DETAILED DESCRIPTION OF THE DRAWINGS

Figure 1A:
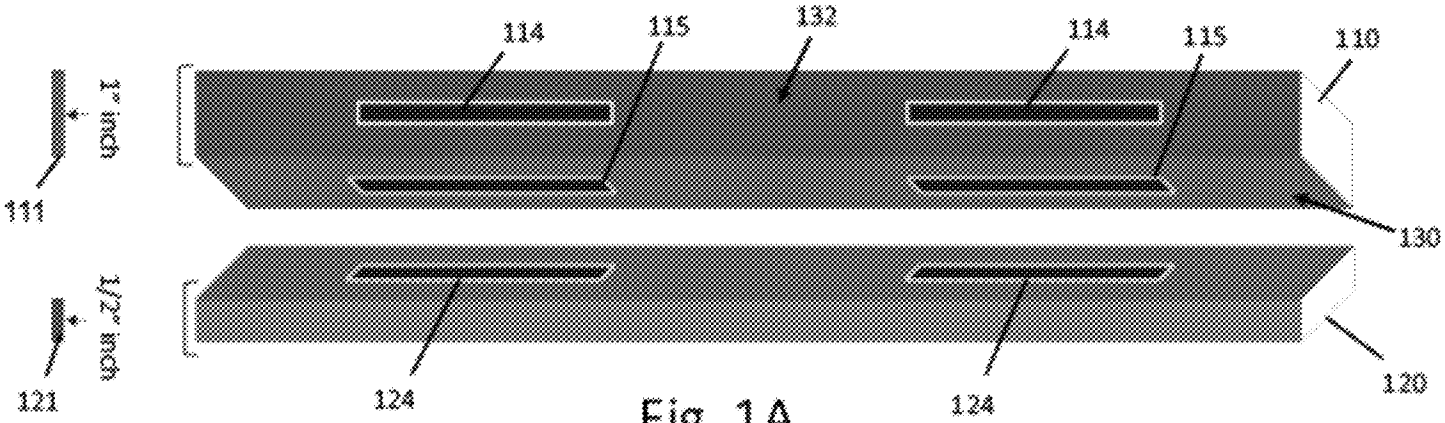
FIGS. 1A and 1B schematically illustrate a set of rulers, according to an embodiment of the invention.

The present invention relates to a fractal-based mandala drawing toolset comprised of a set of rulers, comprised of at least one pair of related rulers, to enable an easy drawing of the required master grid, for the creation of the desirable fractal-based mandala. According to an embodiment of the present invention, the toolset may comprise 8 rulers each having a different width (e.g., 4 pairs of related rulers each having a different width on an inch scale), and in it may further comprise template rulers (e.g., the toolset may comprise 11 rulers). According to an embodiment of the invention, the toolset may further comprise one or more modular rulers that can be combined together to obtain different drawings options. According to an embodiment of the invention, the drawing toolset further comprises one or more guiding booklets, which include appropriate guidelines for drawing fractal-based mandalas by using the toolset's rulers.

For example, a first kit of drawing toolset may comprise modular rulers, one or more inch-based rulers (e.g., 1" inch ruler, ⅞" ruler, etc.), one or more template rulers (e.g., a triangular-shaped template ruler) and a corresponding guiding booklet. A second kit of drawing toolset may comprise one or more inch-based rulers (e.g., 12⅞" inch ruler, 10.⅝" ruler, etc.), one or more template rulers (e.g., a triangular-shaped template ruler) and a corresponding guiding booklet. A third kit of drawing toolset may comprise one or more template rulers and a corresponding guiding booklet.

Figure 1B:
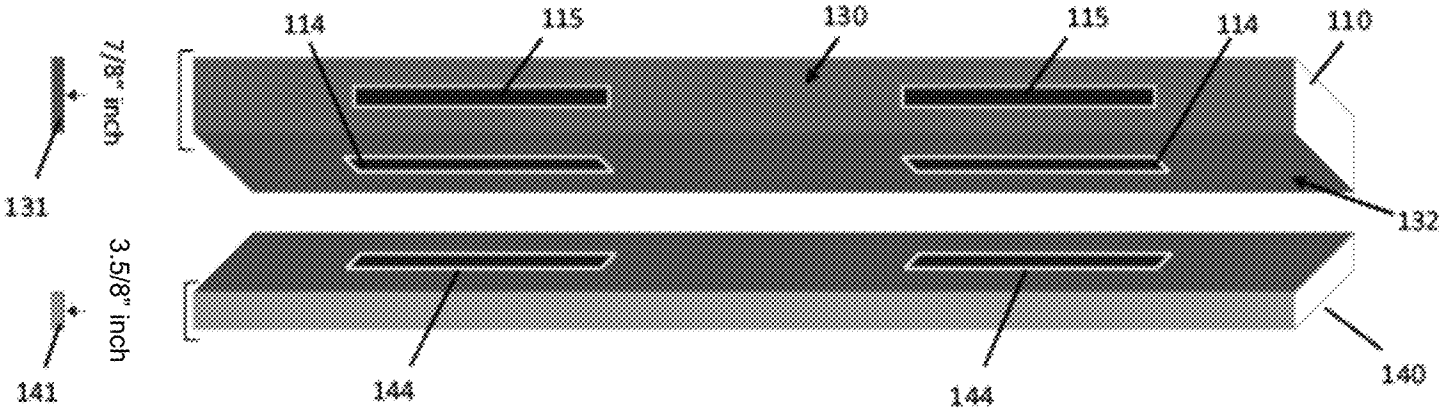
Figure 1F:
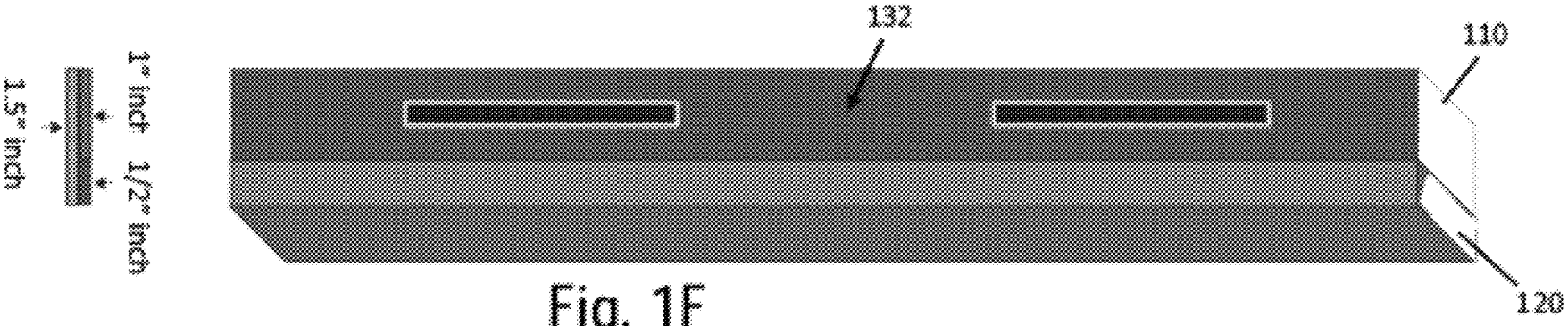
FIG. 1F schematically illustrates the exclusive joining of related rulers of FIG. 1A and FIG. 1C schematically illustrates the exclusive joining of related rulers of FIG. 1B, according to an embodiment of the invention.

FIGS. 1A and 1B schematically illustrate a set of modular rulers of a drawing toolset in accordance with an embodiment of the present invention, in which the toolset is comprised of three rectangular cross-sectioned rulers 110, 120 and 140. A first side 130 of ruler 110 together with ruler 120 form a first pair of related rulers as shown in FIG. 1A, in which the first side 130 ruler 110 having a width of 1" inch (as schematically indicated by numeral 111), and one side of ruler 120 having a width of ½" inch as schematically indicated by numeral 121). A second side 132 of ruler 110 together with ruler 140 form a second pair of related rulers as shown in FIG. 1B, in which the second side 132 of ruler 110 having a width of ⅞" inch (as schematically indicated by numeral 131), and one side of ruler 140 having a width of 3.⅝" inch as schematically indicated by numeral 141). FIGS. 1A and 1B additionally illustrate magnetic attachment means 114, 115, 124 and 144 positioned in a suitable polarity to distinguish between each two related sides of rulers 110, 120 and 140, and allow the exclusive joining of related sides (e.g., side 130 of ruler 110 with ruler 120), and avoiding the erroneous usage of unrelated rulers (e.g., side 132 of ruler 110 with ruler 140). Each ruler 110, 120 and 140 may have the same length that should be suitable to be used to create a master grid (e.g., a length of 333.33 millimeter).

Figure 1C:
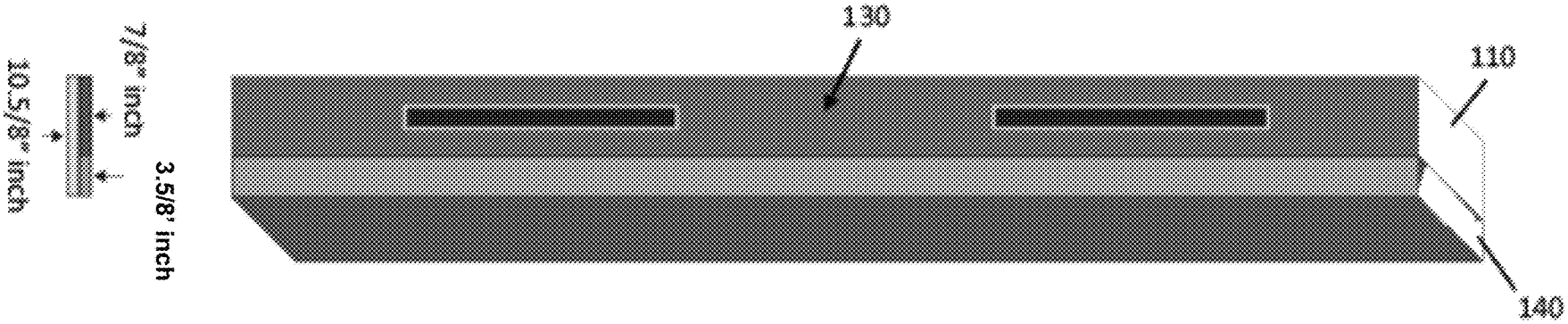
FIGS. 1D and 1E schematically illustrate different combinations of exclusively joining related rulers, according to an embodiment of the invention.

FIG. 1C schematically illustrates the exclusive joining of side 130 of ruler 110 with ruler 120 that creates the width of 1.5" inch (by combining their widths), and the exclusive joining of side 132 or ruler 110 with ruler 140 that creates the width of 10.⅝" inch (by combining their widths).

Figure 1D:
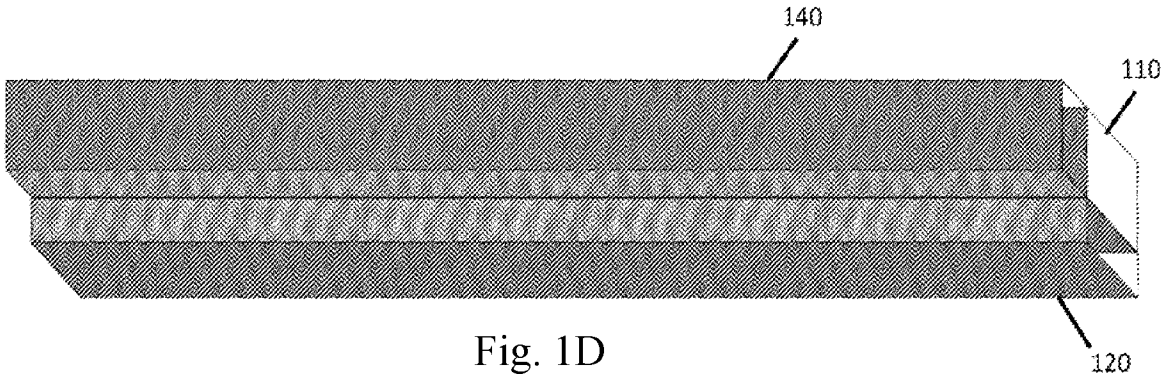
Figure 1E:
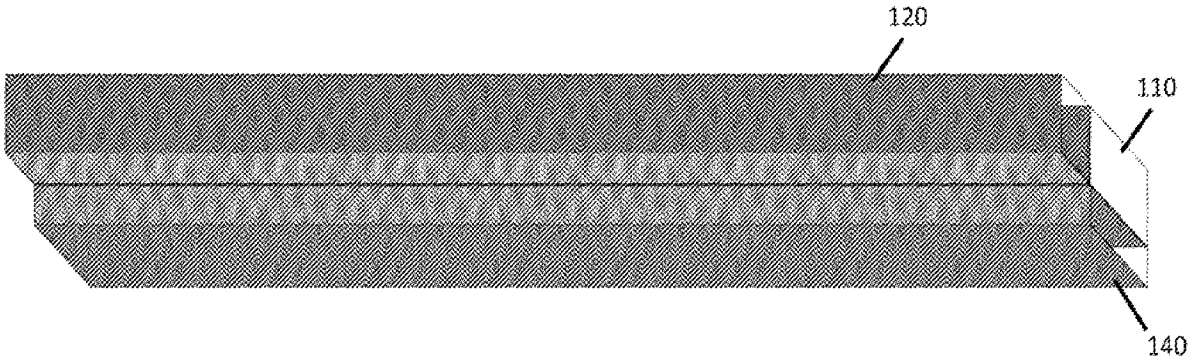

FIGS. 1D and 1E schematically illustrate different combinations of exclusively joining related rulers to expand the possibilities of the inch-based scales, by using elements such as rulers 110, 120 and 140 as described with respect to FIGS. 1A and 1B hereinabove.

Figures 2A, 2G, 2H, 2I:
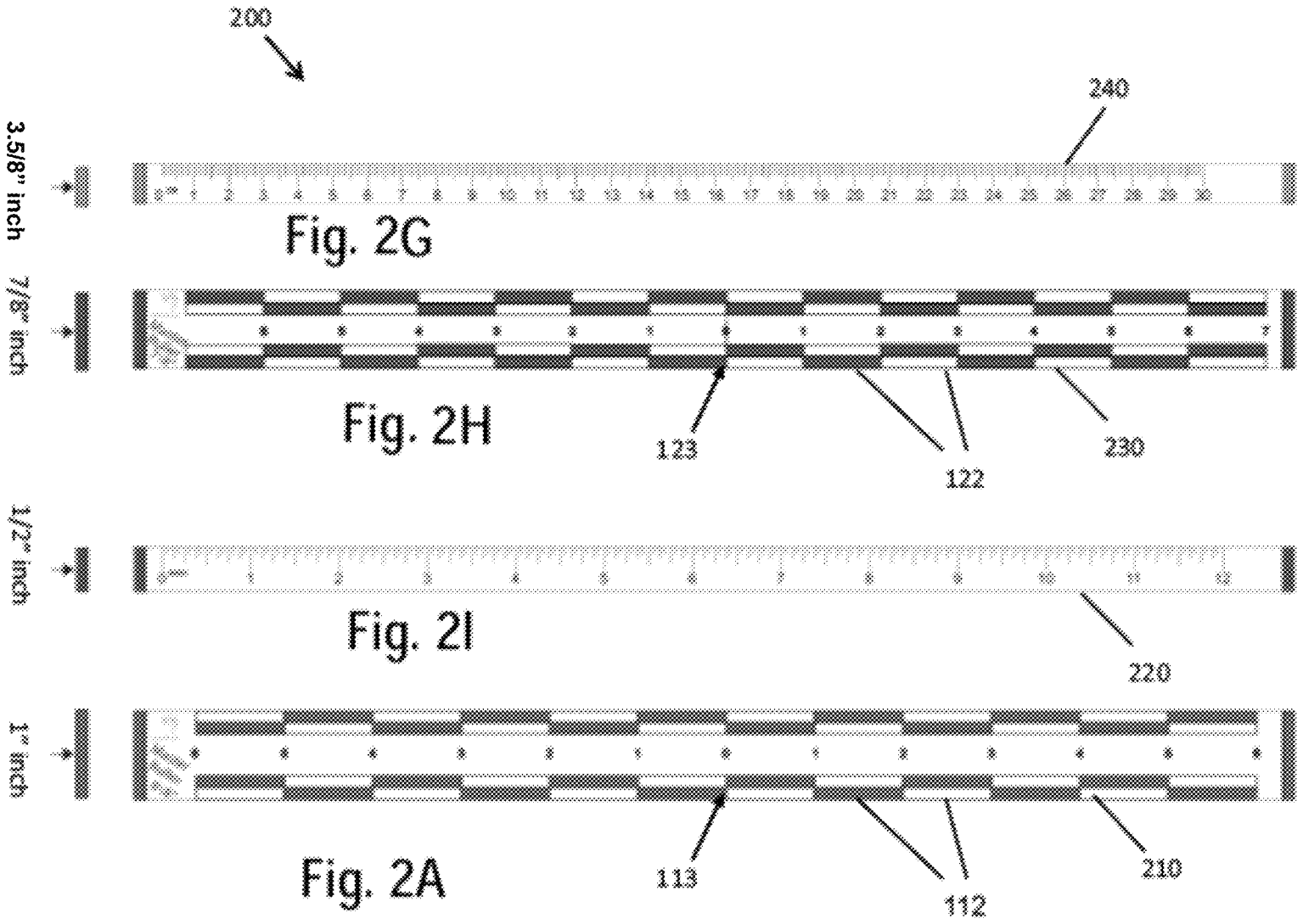
FIGS. 2A, 2G, 2H, and 2I schematically illustrate variations of rulers, according to an embodiment of the invention.

FIG. 2A schematically illustrates a set of rulers 200, according to an embodiment of the invention. The set of rulers 200 comprises at least 4 rulers 210, 220, 230 and 240, wherein the width of each ruler represents a different scale. The rulers 210-240 of set 200 may have an essentially flat form of common plastic or steel rulers. Ruler 210 represents 1" inch, ruler 220 represents ½" inch, ruler 230 represent ⅞" inch and ruler 240 represent 3.⅝" inch. As shown in the figure, at least some of the rulers in set 200 accompanied by alternating colored rectangular units of measure markings along their length, as schematically indicated by numeral 112 and 122. According to an embodiment of the invention, the measuring markings 112 and 122 of each ruler are symmetrically arranged along each ruler scales as indicated by numerals 113 and 123 at the center (i.e., "0") of each ruler. Similar to the rulers of FIGS. 1A and 1B, each ruler 210-240 may have the same length that should be suitable to be used to create a master grid (e.g., a length of 333.33 millimeter).

Figure 2B:
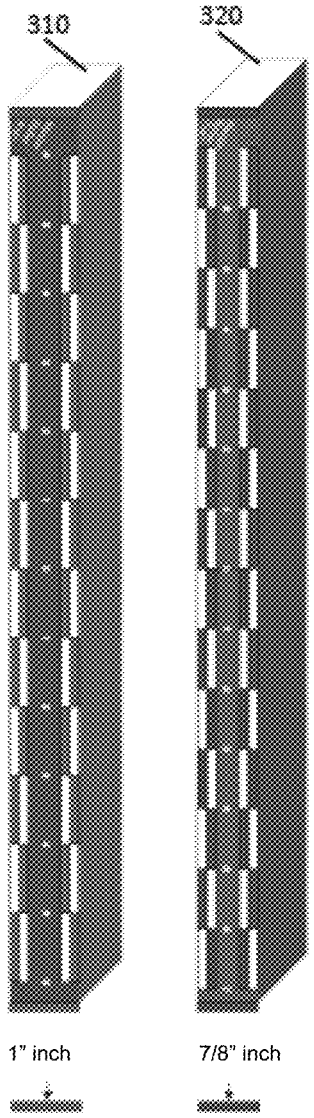
FIGS. 2B-2D schematically illustrate variations of rulers that combine features from the set of rulers of FIGS. 2A, 2G, 2H, and 2I with the rulers of FIGS. 1A and 1B, according to an embodiment of the invention.
Figure 2C:
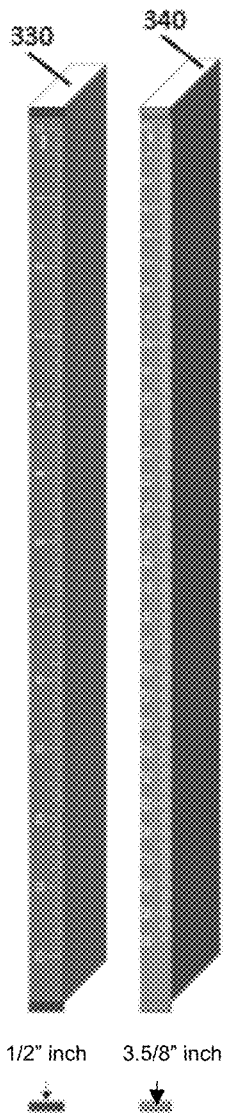
Figure 2D:
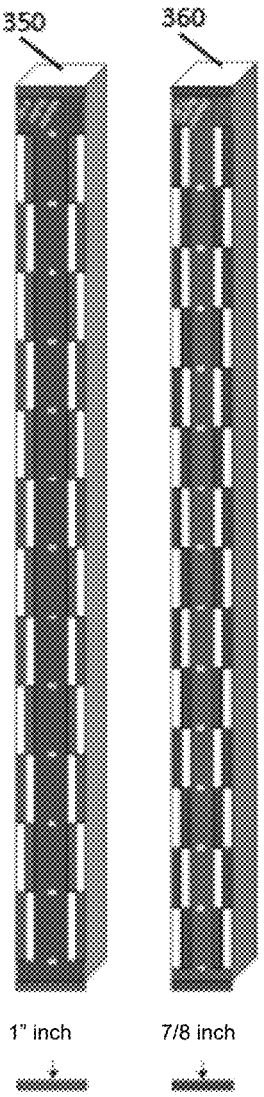

FIGS. 2B-2D schematically illustrate variation of rulers 310, 320, 330, 340, 350 and 360, that combines the features of rulers of set 200 of FIG. 2 (e.g., alternating markings and/or scales that appear on rulers 210-240) with three-dimensional structures of the rectangular cross-sectioned rulers 110, 120 and 140 of FIGS. 1A and 1B. For example, rulers 310 and 320 can be a variation of ruler 110 in which one side has a width of 1" inch (as indicated by ruler 310) and its adjacent side has a width of ⅞" inch (as indicated by ruler 320), rulers 330 and 360 can be a variation of ruler 120 in which one side has a width of ½" inch (as indicated by ruler 330) and its adjacent side has a width of ⅞" inch (as indicated by ruler 360), and rulers 340 and 350 can be a variation of ruler 140 in which one side has a width of 3.⅝" inch (as indicated by ruler 340) and its adjacent side has a width of 1" inch (as indicated by ruler 350).

Figure 2E:
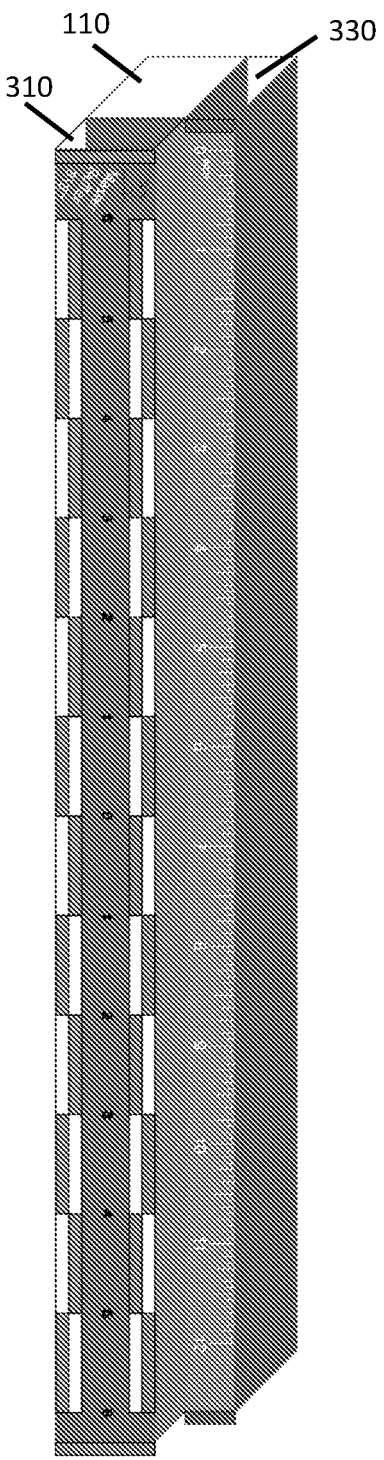
FIGS. 2E and 2F schematically illustrate different combinations of exclusively joining related rulers of FIGS. 2B-2D and of FIGS. 1A and 1B, according to an embodiment of the invention.
Figure 2F:
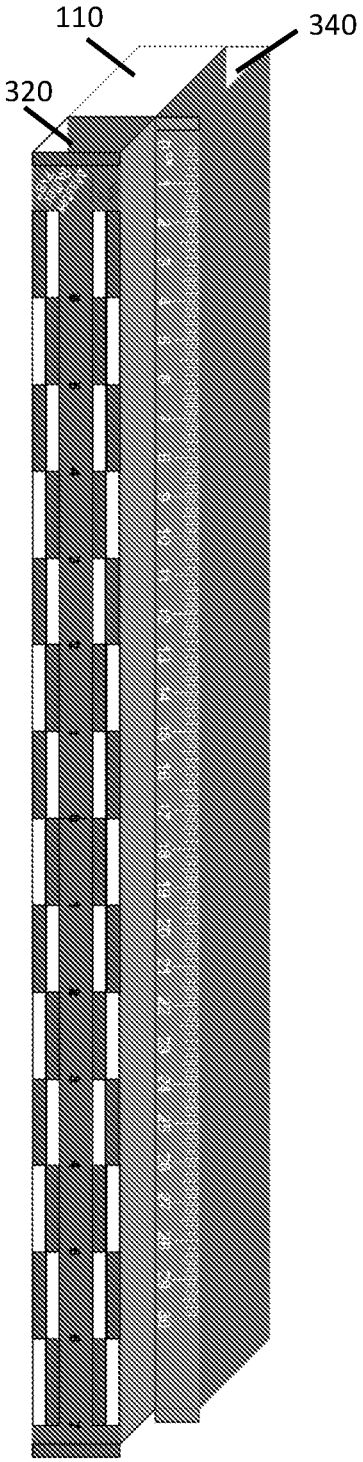

FIGS. 2E and 2F schematically illustrate different combinations of exclusively joining related rulers of FIGS. 2B-2D and of FIGS. 1A and 1B to expand the possibilities of the inch-based scales, according to an embodiment of the invention.

Figure 3A:
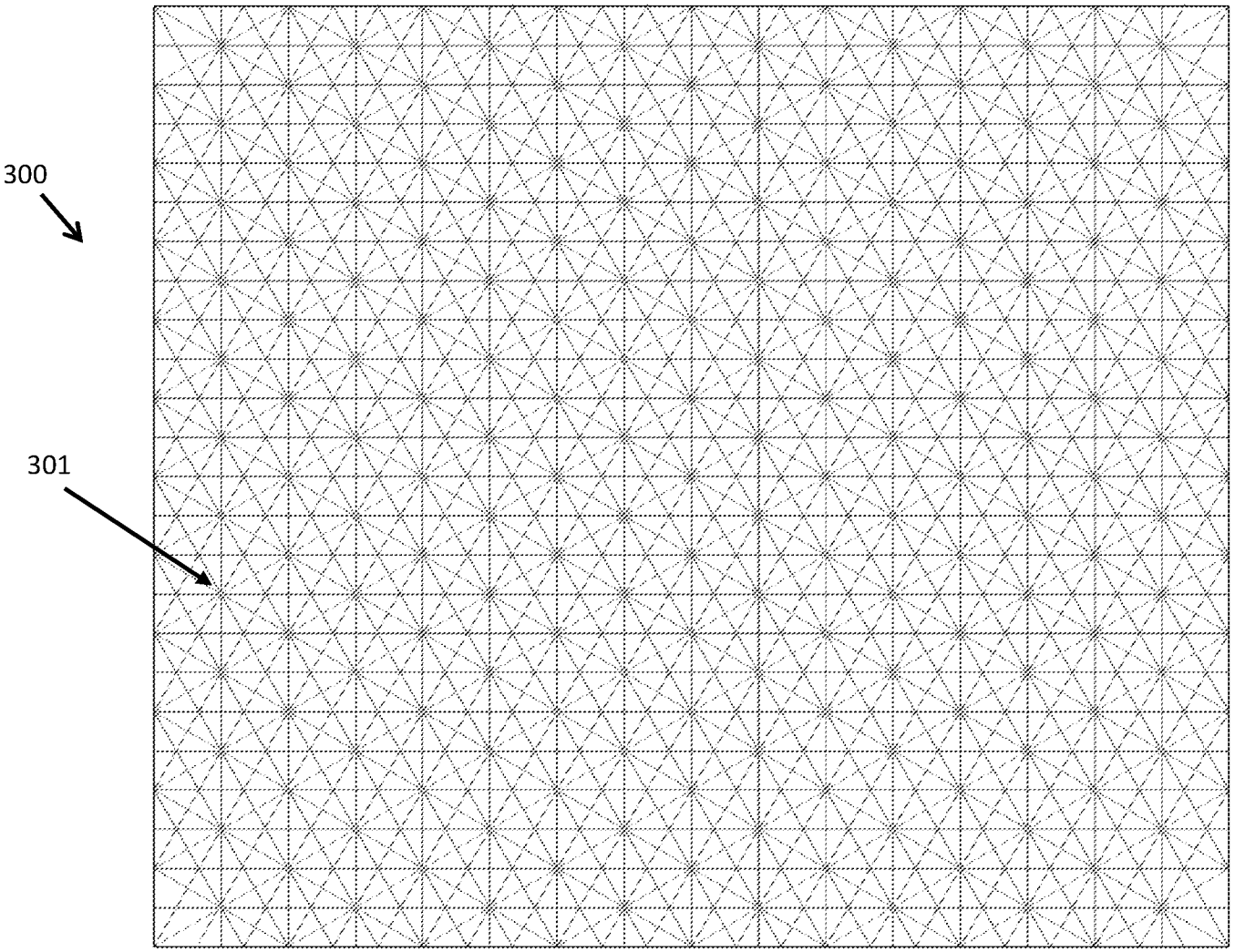
FIG. 3A schematically illustrates an example of a master grid that can be created by the set of rulers of FIG. 2, according to an embodiment of the invention FIGS. 3B and 3C schematically demonstrate the creation of the master grid of FIG. 3A, according to an embodiment of the invention.

FIG. 3A schematically illustrates an example of a master grid 300 which is utilized as the infrastructure for creating a mandala drawing, according to an embodiment of the invention. Maser grid 300 comprises plurality of guiding lines that their crossings creates a plurality of intersection points as for example indicated by numeral 301. Master grid can be created by one or more of the rulers as described with respect to FIGS. 1A, 1B and 2A-2D hereinabove.

Figure 3B:
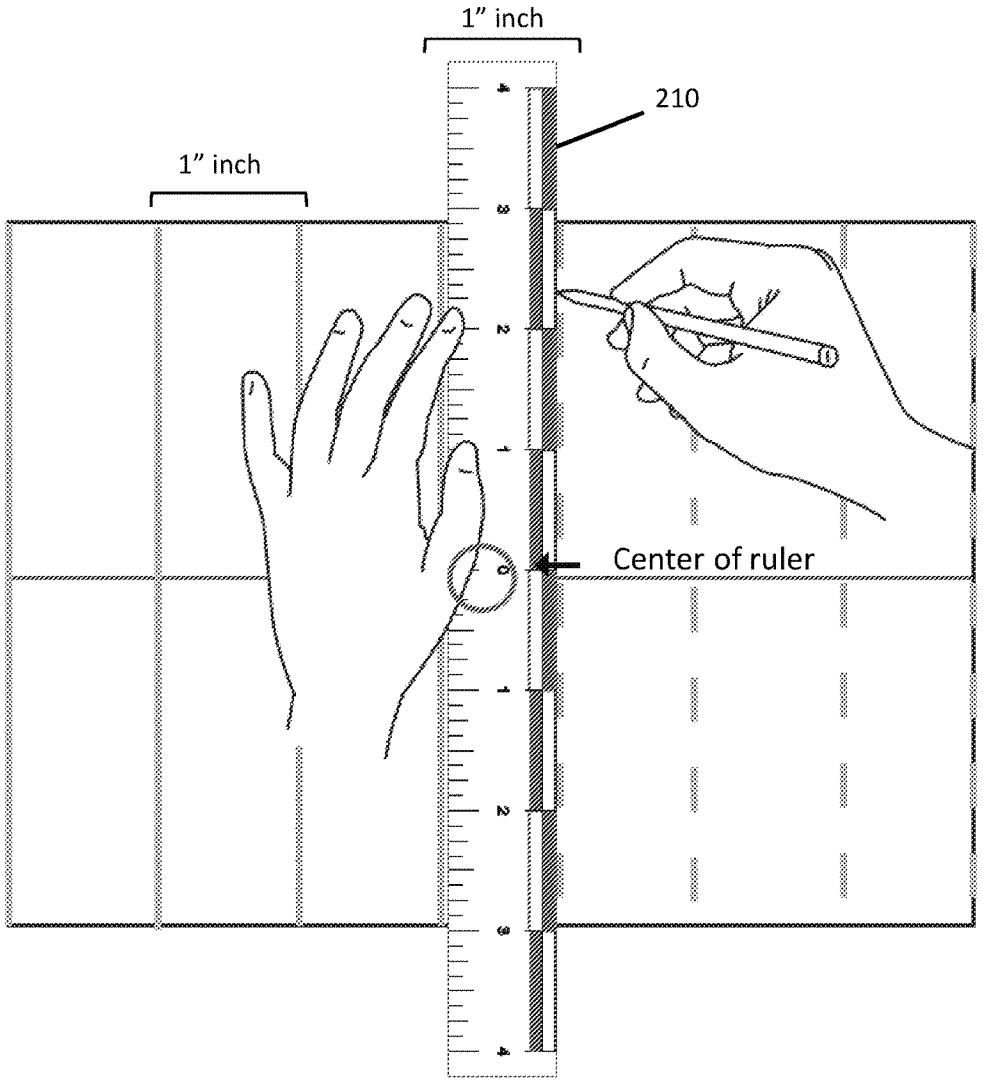
Figure 3C:
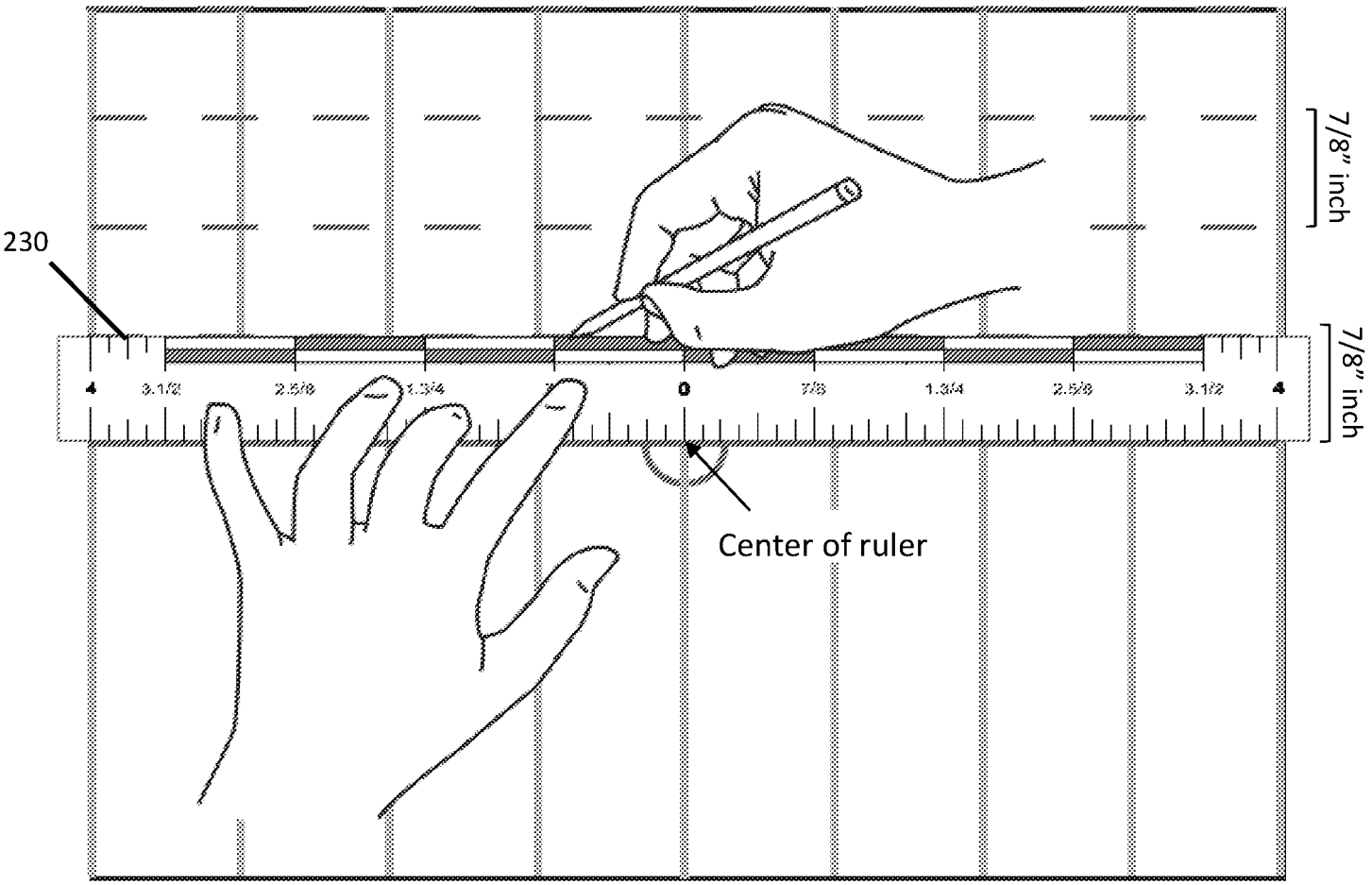

FIGS. 3B and 3C schematically demonstrate the creation of the master grid 300 by using at least some of the aforementioned rulers, according to an embodiment of the invention. FIG. 3B schematically illustrates one of the initial steps to create mater grid 300, in which the width of ruler 210 (i.e., 1" inch) is used to draw the vertical lines of master grid 300. In this example, the center of ruler 210 (i.e., as indicated by "0") is used to indicated the horizontal center of the master grid 300. FIG. 3C schematically illustrates a following step to create mater grid 300, in which the width of ruler 230 (i.e., ⅞" inch) is used to draw the horizontal lines of master grid 300. In this example, the center of ruler 230 (i.e., as indicated by "0") is used to indicated the vertical center of master grid 300.

Figure 4A:
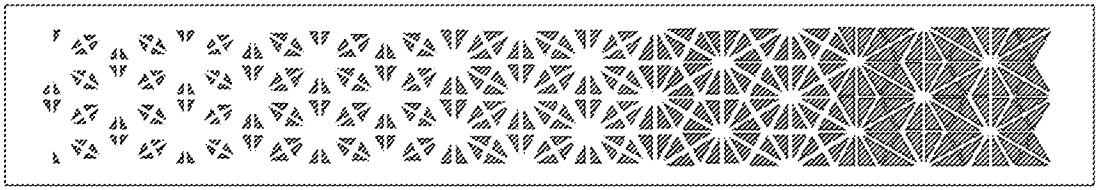
FIGS. 4A-4C schematically illustrates examples of designs that can be created by the master grid of FIG. 3A.
Figure 4B:
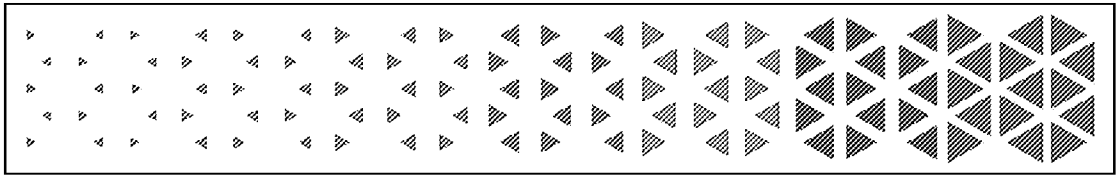
Figure 4C:
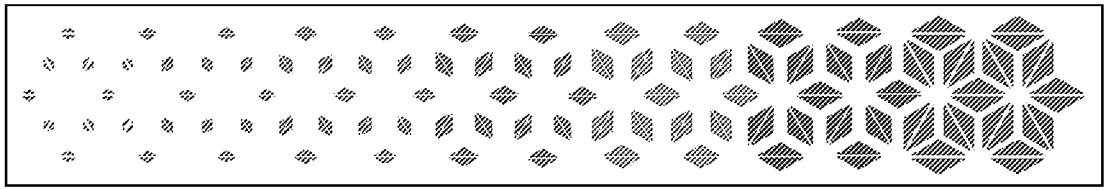
Figure 5:
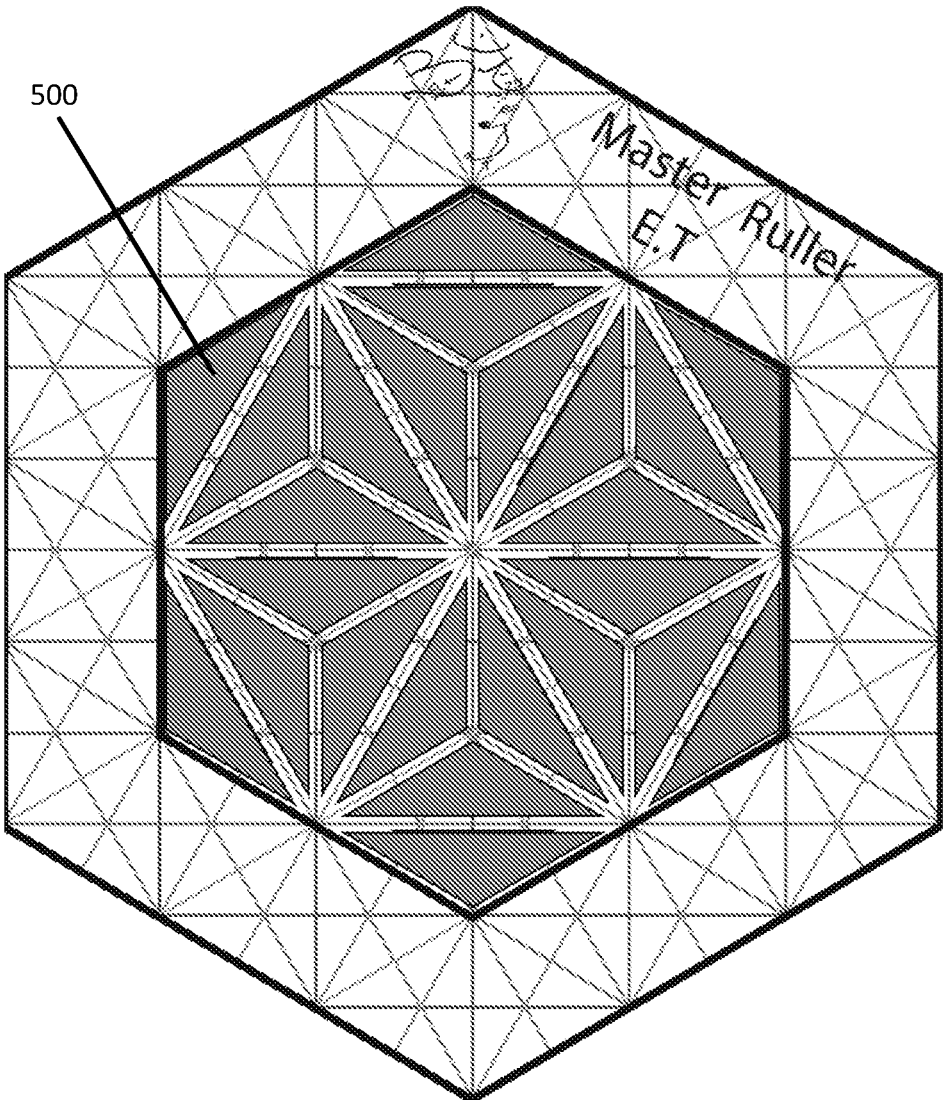
FIG. 5 schematically illustrates a template ruler in form of a fractal-based shape, according to an embodiment of the invention.

FIGS. 4A-4C schematically illustrate examples of longitude templates ruler that can be used on master grid 300 to create a fractal-based mandala. FIG. 5 schematically illustrates an example of a template ruler 500 in form of a fractal-based mandala (e.g., six-leaf mandala).

Figure 6A:
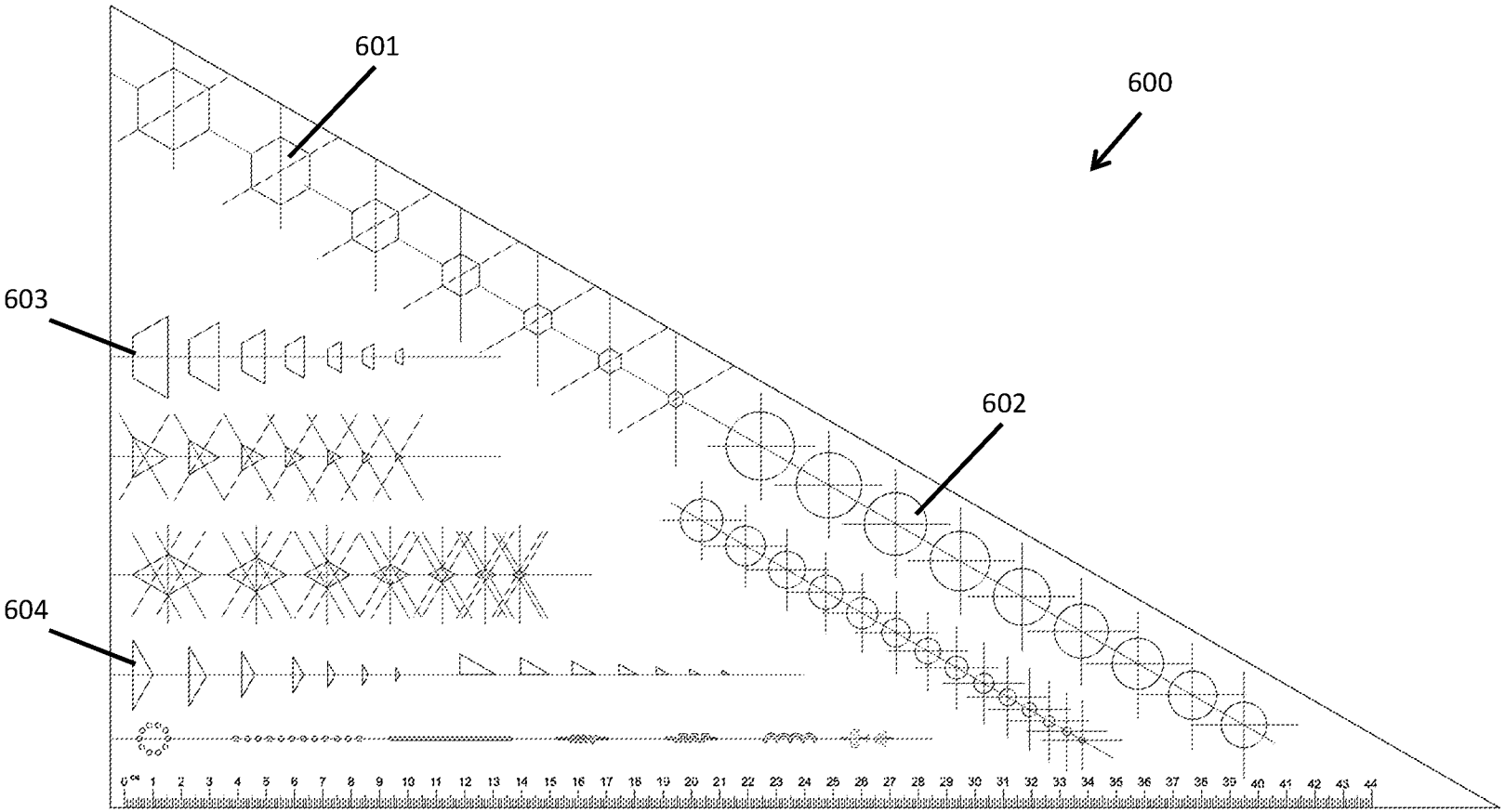
FIG. 6A schematically illustrates an example of a template ruler in form of a triangular, according to an embodiment of the invention.
Figure 6C:
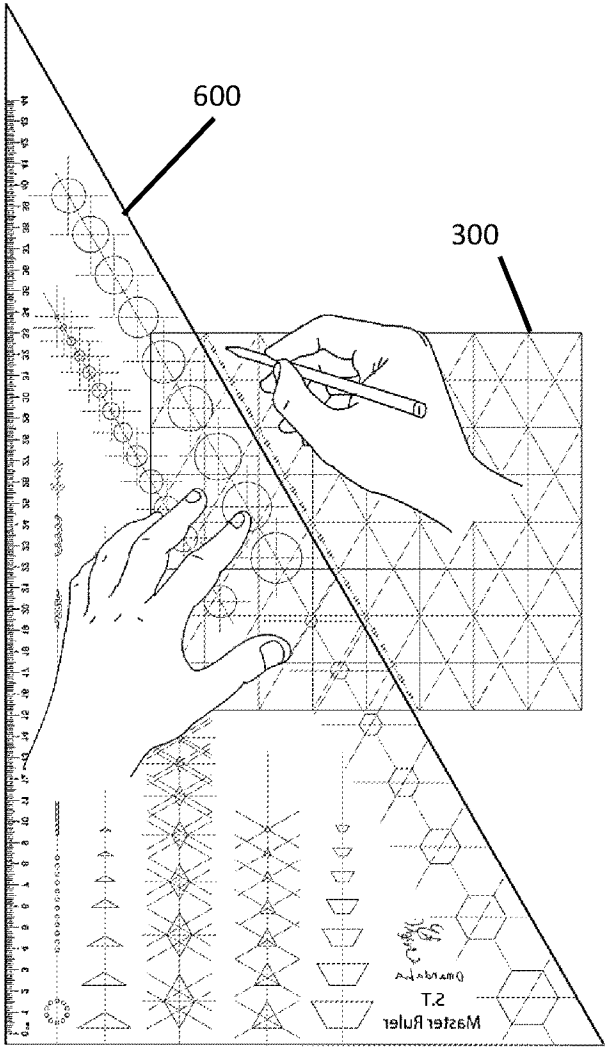
FIG. 6B-6I schematically illustrate the steps of drawing a master grid by using the template ruler of FIG. 6A, according to an embodiment of the present invention.
Figure 6B:
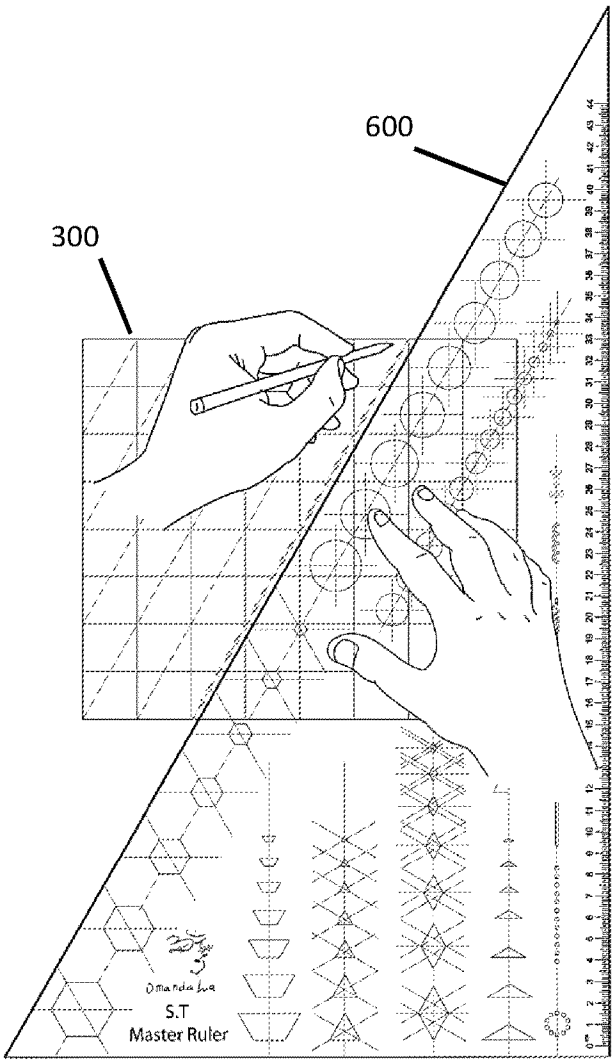
Figure 6D:
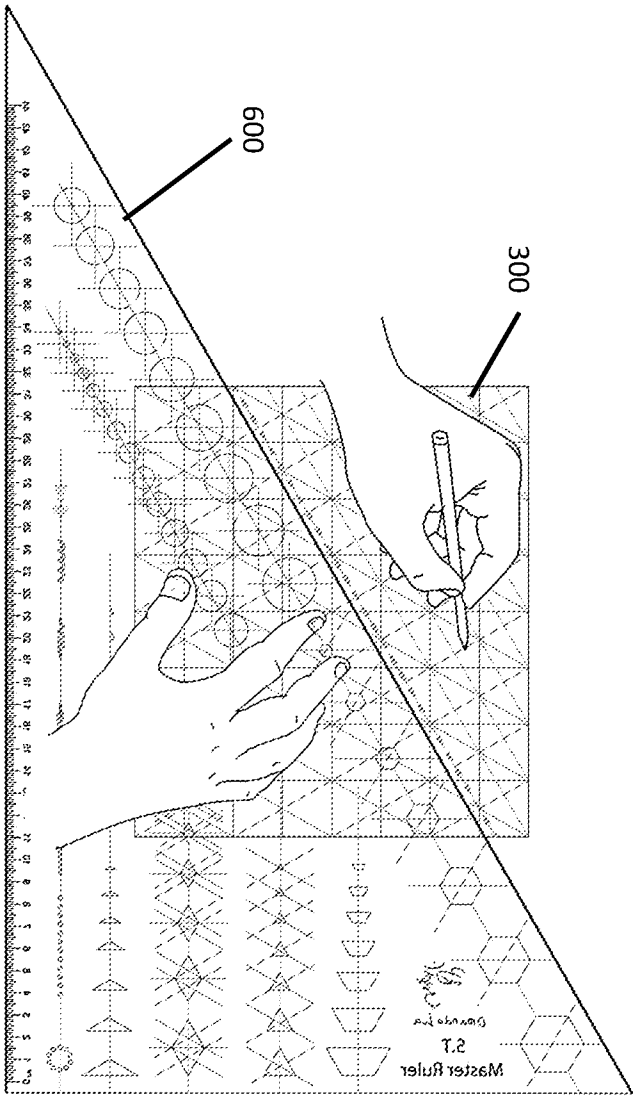
Figure 6E:
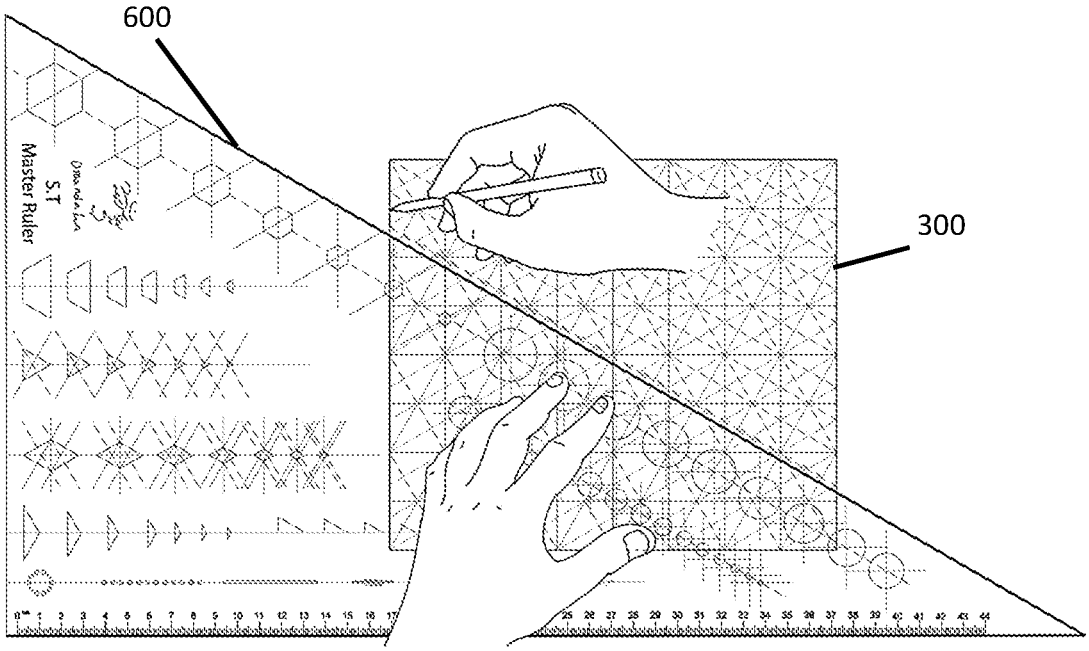
Figure 6G:
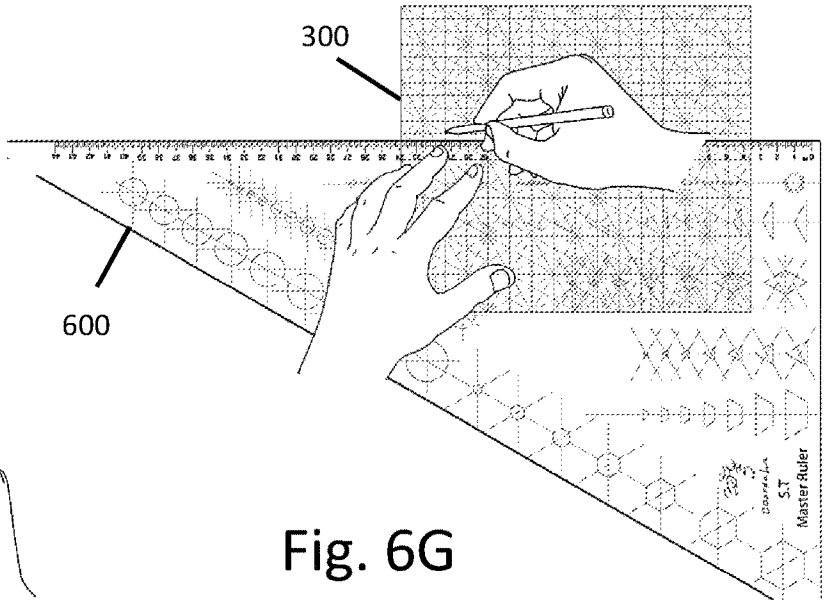
Figure 6F:
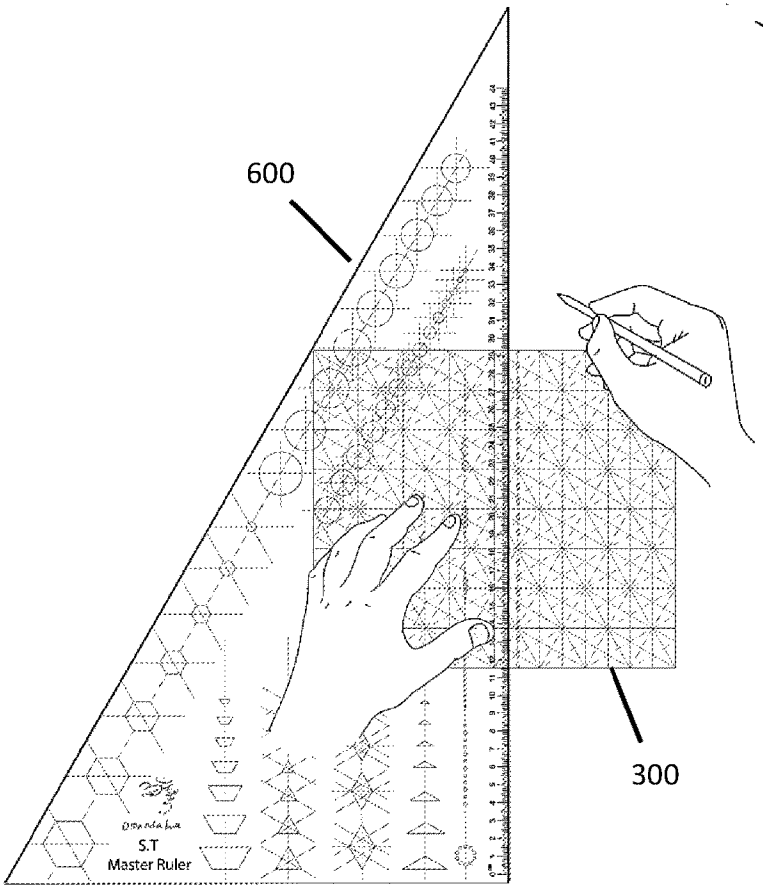
Figure 6I:
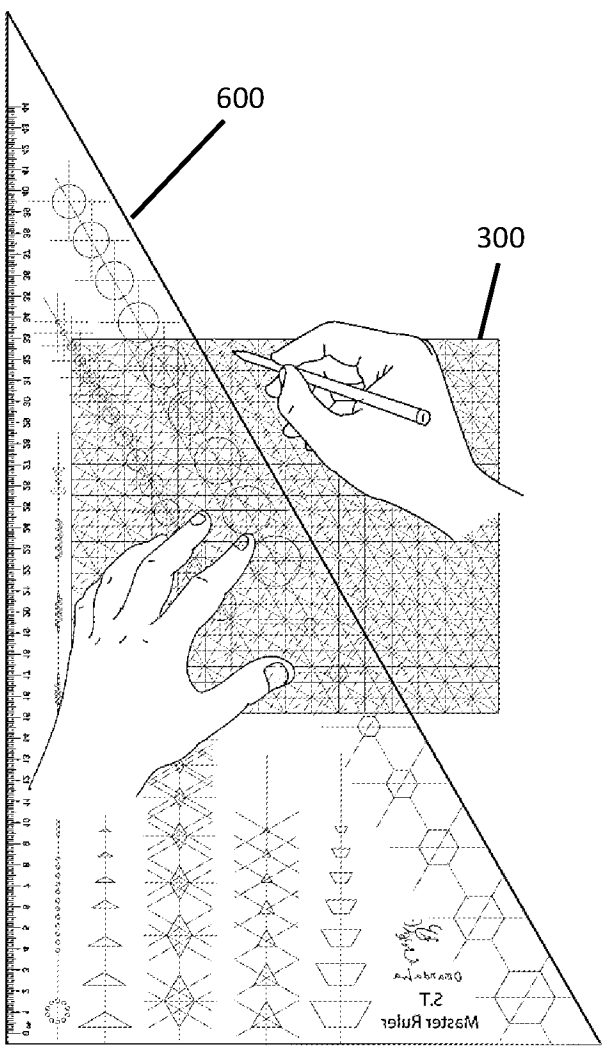
Figure 6H:
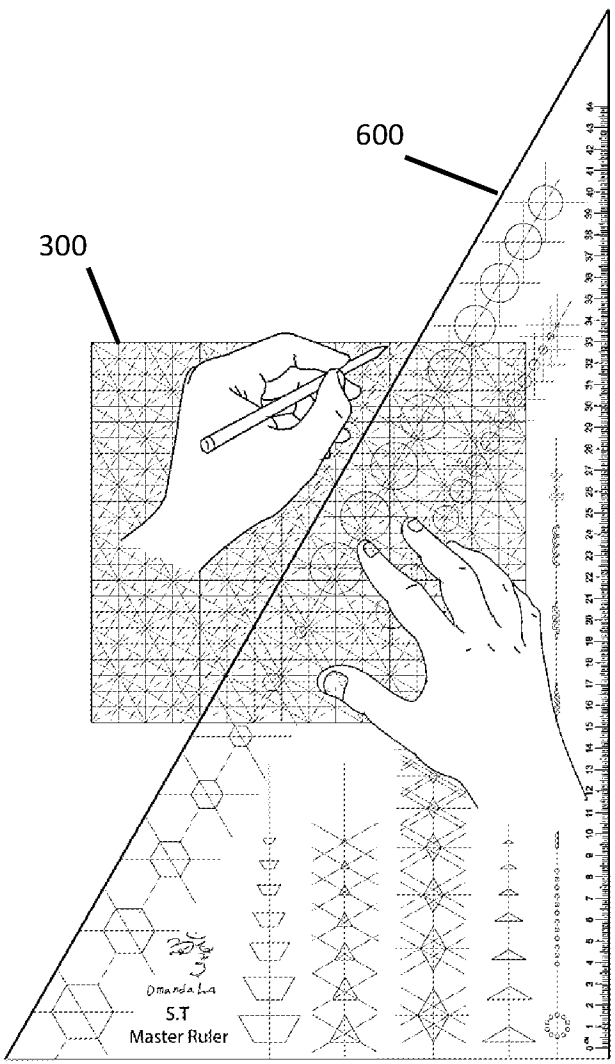
Figure 7B:
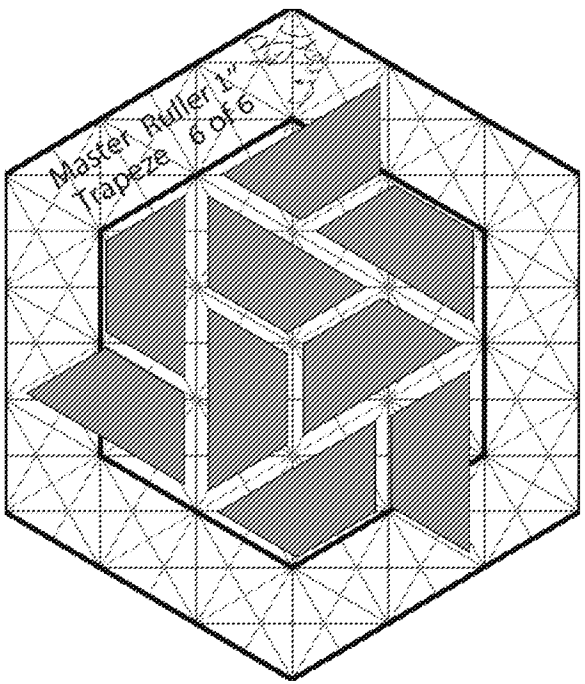
FIG. 7A-7J schematically illustrate examples of different template rulers in form of fractal-based shapes, according to an embodiment of the present invention.
Figure 7A:
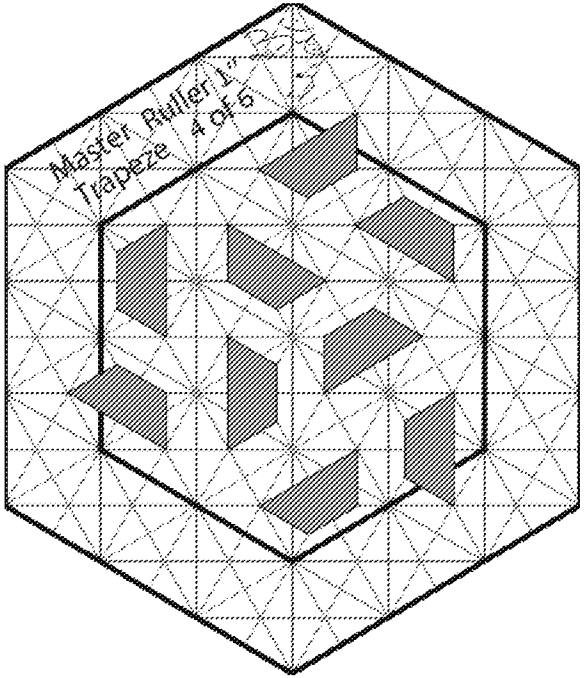
Figure 7D:
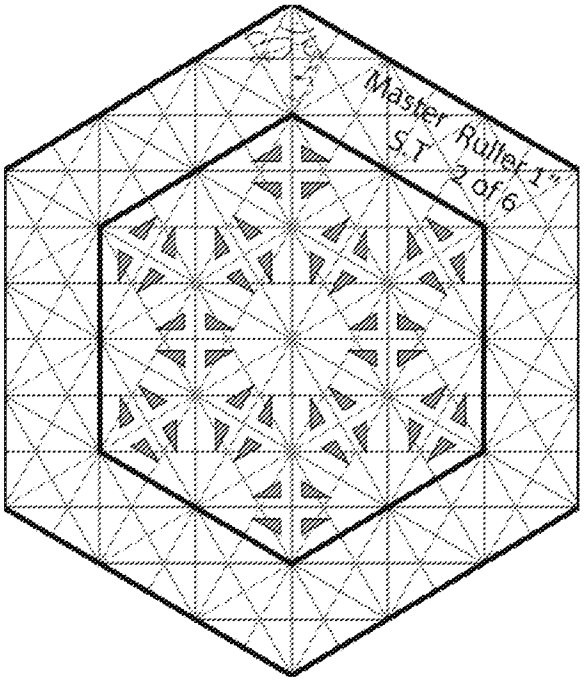
Figure 7C:
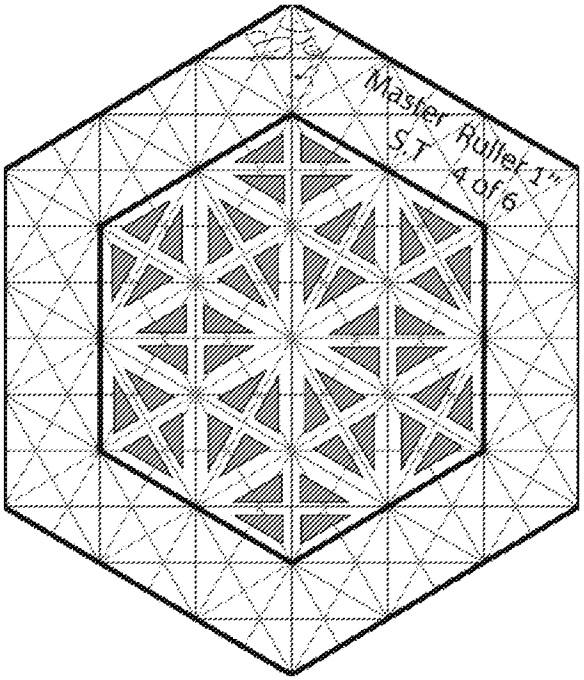
Figure 7F:
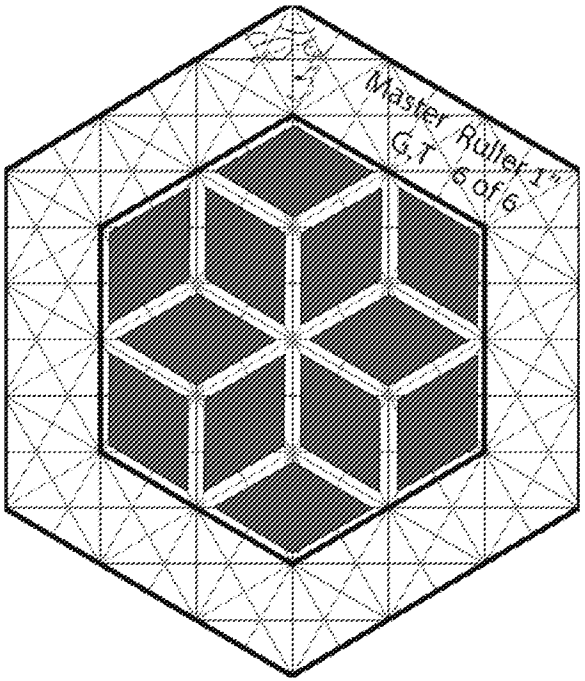
Figure 7E:
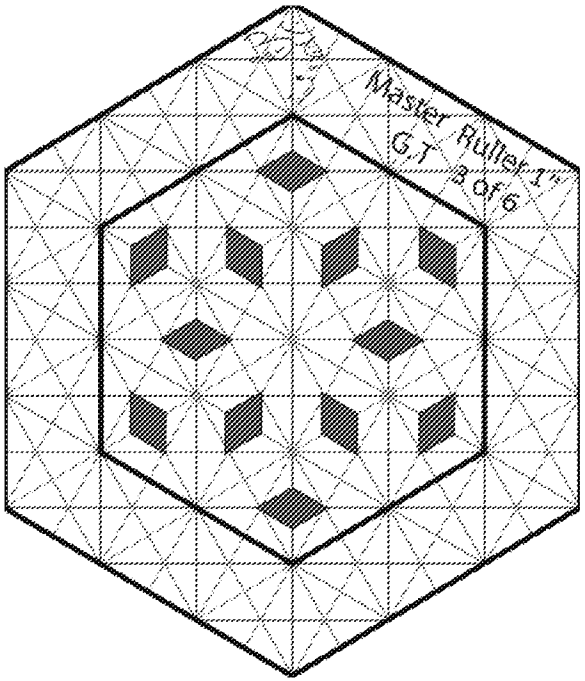
Figure 7H:
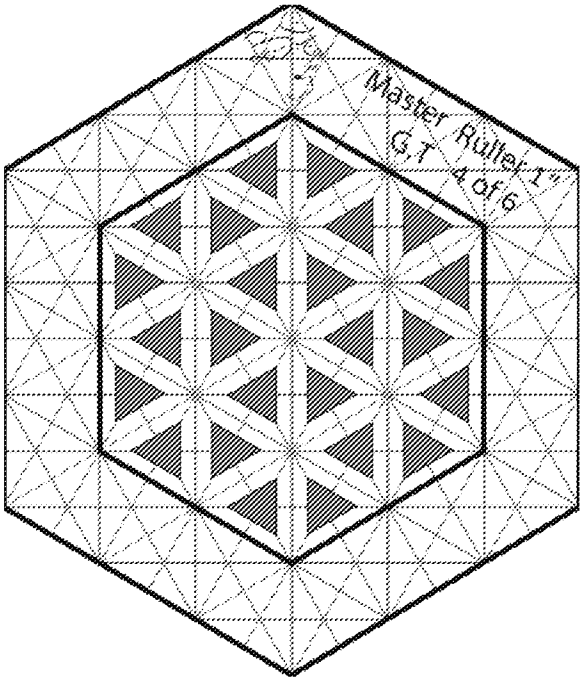
Figure 7G:
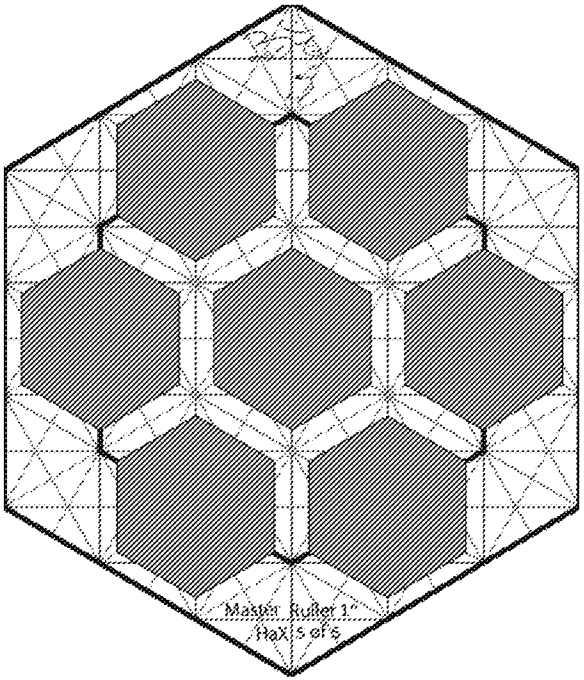
Figure 7J:
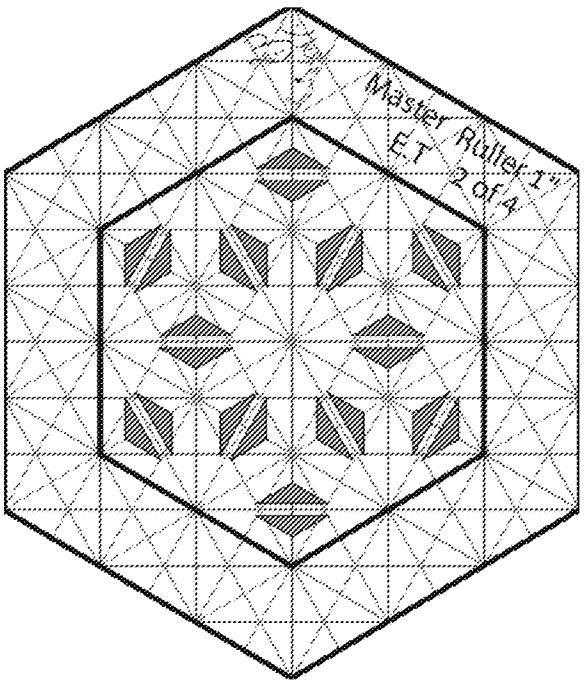
Figure 7I:
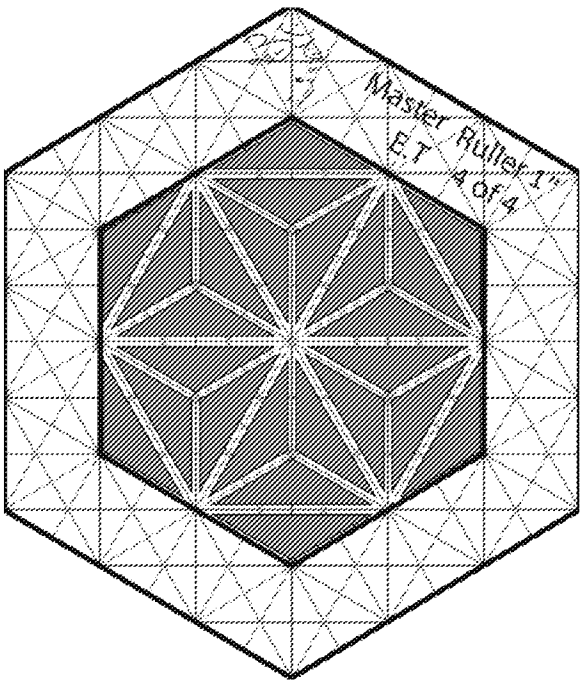

FIG. 6A schematically illustrates an example of a template ruler 600 in form of a triangular, according to an embodiment of the invention. Template ruler 600 can be added to the set of rulers 200 in order to help users to create specific shapes at different sizes on the master grid 300, such as hexagons 601, circles 602, trapezoid shapes 603, triangular shapes 604 or any other suitable geometrical shapes. In this embodiment, each geometrical shape in template ruler 600 is marked with central crossing lines to help users to draw in accordance with the texture of master grid 300.

FIG. 6B-6I schematically illustrate the steps of preparing a master grid (e.g., such as mater grid 300) by using the template ruler 600 of FIG. 6A, according to an embodiment of the present invention. The preparation of the master grid 300 starts at FIG. 6B and ends at FIG. 61.

FIG. 7A-7J schematically illustrate different examples of template rulers in form of fractal-based shapes that can be used as part of the drawing toolset e.g., in addition to the set of rulers 200 and the template ruler 600 for drawing on the master grid 300.

In another embodiment of the current invention, the drawing toolset is comprised of at least one pair of square cross-sectioned scale-less wooden rulers, wherein each two rulers of said pair are related by the ratio of their cross-sectional widths. In this embodiment, a mechanical attachment measures, e.g., latches, of a unique shape are utilized as an exclusive joining option of each two related rulers.

In another embodiment of the current invention, a single rectangular cross-sectioned ruler is utilized instead of a related pair of square cross-sectioned rulers, wherein two of said single ruler's longitudinal faces are of a related cross-sectional height and width, in a similar ratio and utilization as said related pair of rulers of the previous embodiment.

In an embodiment of the current invention, the said toolset is comprised of thin rulers, in which various shaped template cutouts are embedded to allow the uniform subdivision of the master grid with repetitive lines, or arcs.

Although embodiments of the invention have been described by way of illustration, it will be understood that the invention may be carried out with many variations, modifications, and adaptations, without exceeding the scope of the claims.

The invention claimed is:

1. A fractal-based mandala drawing toolset, comprising at least one pair of rulers each having a different cross-sectional width, where each pair of rulers is related by the ratio between their cross-sectional widths, wherein said related pair of rulers and the combination of their widths are utilized for drafting a master grid with a predetermined shape and resolution, which is utilized as the infrastructure for creating a mandala drawing;

wherein a single ruler is utilized in lieu of the related pair of rulers, by sizing or by marking two longitudinal faces of said single ruler in the same manner as two rulers of the related pair are sized or marked.

2. The toolset according to claim 1, wherein at least one of the rulers is marked with scales of and unit of measure marking.

3. The toolset according to claim 2, wherein each pair of rulers is related by the ratio between their units of measure.

4. The toolset according to claim 1, wherein at least one pair of rulers utilize 7/8 and 7/16 ratios for the rulers' (or ruler longitudinal face's) sizes or unit of measures markings.

5. The toolset according to claim 1, in which each related pair of rulers comprises of a unique joining method, to allow the exclusive joining of only two related rulers of said pair.

6. The toolset according to claim 1, in which rulers of similar utilized ratios (e.g., 7/8 and 7/16) comprises of a unique joining method, to allow their joining as a set.

7. The toolset of claim 1, further comprising thin rulers, in which various shaped template cutouts are embedded to allow the drawing of uniform lines, or arcs.

8. The toolset of claim 1, further comprising at least one booklet, which includes appropriate guidelines for drawing fractal-based mandalas by using the rulers.

* * * * *